US005313814A

United States Patent [19]

Yamamoto et al.

[11] Patent Number: 5,313,814

[45] Date of Patent: May 24, 1994

[54] BENDING MACHINE

[75] Inventors: Makoto Yamamoto; Tsuyoshi Matsumoto, both of Komatsu, Japan

[73] Assignee: Kabushiki Kaisha Komatsu Seisakusho, Tokyo, Japan

[21] Appl. No.: 967,985

[22] Filed: Oct. 27, 1992

[51] Int. Cl.[5] ..... B21D 5/04

[52] U.S. Cl. ..... 72/319; 72/323; 72/446; 72/481

[58] Field of Search ..... 72/323, 319, 320, 321, 72/389, 446, 481

[56] References Cited

U.S. PATENT DOCUMENTS

| | | | |
|---|---|---|---|
| 4,055,066 | 10/1977 | Lamendour | 72/323 |
| 4,658,624 | 4/1987 | Ridgeway | 72/323 |
| 4,660,402 | 4/1987 | Hongo | 72/323 |
| 4,722,214 | 2/1988 | Hayashi | 72/319 |
| 4,930,332 | 6/1990 | Hongo | 72/323 |

FOREIGN PATENT DOCUMENTS

| | | |
|---|---|---|
| 61-152325 | 9/1986 | Japan . |
| 1-16568 | 3/1989 | Japan . |

*Primary Examiner*—Daniel C. Crane
*Attorney, Agent, or Firm*—Richards, Medlock & Andrews

[57] ABSTRACT

A bending machine, capable of accurately bending a workpiece to a desired angle while protecting the workpiece from damage, comprises an upper die fastened to a ram, which is movable vertically and acts in cooperation with a stationary table to fix a workpiece to be bent, a bending blade selection arm which can be vertically swung by a bending blade selection cylinder and to which a downward bending beam and an upward bending beam are fastened in such a manner that the downward bending beam and the upward bending beam are able to swing while being vertically separated from each other, a downward bending blade for bending the workpiece downwardly when the downward bending beam is swung by a downward blade swing cylinder, and an upward bending blade for bending the workpiece upwardly when the upward bending beam is swung by an upward bending blade swing cylinder. Therefore, the upward and the downward bending blades do not rub the workpiece.

20 Claims, 11 Drawing Sheets

BENDING MACHINE

BACKGROUND OF THE INVENTION

1. Field of the Invention

The present invention relates to a bending machine capable of bending a plate-like workpiece while protecting it from damage.

2. Related Art

In a case where a plate-like workpiece is bent, so-called "spring back" takes place, which is a phenomenon causing the bent workpiece to be slightly deformed from the desired shape due to an elastic restoration of the bent workpiece.

Hitherto, a workpiece has been bent by a surplus amount to take the aforesaid "spring back" into account so as to obtain the desired shape. In order to bend the workpiece as described above, it has been known, for example, Japanese Published Unexamined Utility Model Application No. (U) 61-152325, to adapt a bending machine in such a manner that a bending blade is disposed at the leading portion of a rocker arm to be rotated in a vertical direction by a double action actuator so as to bend the workpiece by the bending blade which is moved by the vertical movement of the rocker arm, and an eccentric member for supporting the base portion of the rocker arm is rotated so as to horizontally displace the overall body of the rocker arm, so that the amount of the "spring back" is corrected.

However, a problem arises in that the quality of the product deteriorates in a case where a workpiece, the surface of which has been treated with a surface treatment such as a coating or zinc plating, is bent because the aforesaid bending machine performs the bending operation in a state where the bending blade rubs the workpiece, and therefore the surface of the workpiece is damaged. What is worse, the cost of a control system cannot be reduced because complicated control must be performed to obtain a desired bending angle.

In a case where a panel arranged as shown in FIG. 19 is formed from a plate-like workpiece a, a shorter side edge b of the workpiece a is bent first, then the workpiece a is rotated by 90° so that a clamping die or an upper die is adjusted to the width to be bent which is aligned to the inside of the bent portion of the shorter side edge b, and then a longer side c is bent.

In a bending operation of the aforesaid type, the upper die for bending the longer side edge c must have a length obtained by subtracting thickness corresponding to those of two workpieces a from the length of the longer side because the bent shorter side edge b has been raised. In addition, the die must be separated after it has bent the longer side edge c in such a manner that the die cannot be caught by the shorter side edge b. Technology capable of achieving the aforesaid requirement has been disclosed in Japanese Patent Publication No. 1-16568 in which the interference is prevented by arranging the structure in such a manner that an opening die, which can be rotated by a pin or a link, is disposed on a corner of the upper die.

However, each of the aforesaid opening dies is structured in such a manner that it is rotated by the dead weight thereof to prevent the interference. Therefore, when the ram starts moving upwardly at the time of separating the die, the opening die moves to prevent the interference while being in contact with the upper surface of the workpiece which has been molded. Also at the time of the bending operation, the opening die, which has been moved to a position at which the interference can be prevented with the downward movement of the ram, moves to the position at which molding is performed while being in contact with the upper surface of the workpiece. Therefore, a problem arises in that the quality of the product deteriorates excessively due to damage caused from rubbing in a case where the workpiece is made of colored iron plate or which has been coated with paint.

SUMMARY OF THE INVENTION

Accordingly, an object of the present invention is to provide a bending machine which is capable of overcoming the aforesaid problems, which does not damage the surface of a workpiece and which is capable of performing the bending operation under simple controls. In order to achieve this, the bending machine according to the present invention comprises an upper die fastened to a ram, with the ram being movable vertically and acting in cooperation with a stationary table to fix a workpiece to be bent, a bending blade selection arm which can be moved by a bending blade selection actuator. A downward bending beam and an upward bending beam are fastened to the bending blade selection arm in such a manner that the downward bending beam and the upward bending beam are able to move while being separated from each other. A downward bending blade is provided for bending a portion of the workpiece downwardly when the workpiece is fixed between the upper die and the stationary table and the downward bending beam is moved by a downward bending blade actuator. An upward bending blade is provided for bending a portion of the workpiece upwardly when the workpiece is fixed between the upper die and the stationary table and the upward bending beam is moved by an upward bending blade actuator. Therefore, the upward and the downward bending blades do not rub the workpiece.

Since the structure is arranged as described above, the direction in which the workpiece is bent is selected by. rotating the bending blade selection arm by the bending blade selection actuator. By the use of the downward bending blade actuator to swing the downward bending beam or the use of the upward bending blade actuator to swing the upward bending beam, the workpiece can be accurately bent while protecting the surface of the workpiece from damage caused by the downward bending blade or the upward bending blade.

According to another aspect of the present invention, there is provided a bending machine comprising a ram, an upper die group fastened to the ram, an opening die body disposed at least one of the two end portions of the upper die group, and at least one opening die the upper portion of which is rotatively fastened to an opening die body, wherein each opening die can be rotated by an actuator to a first position at which the workpiece is bent and to a second position at which the opening die is retracted in order to prevent interference with the workpiece.

As a result of the structure thus arranged, the opening die can be rotated from the retracted position to the position at which the workpiece is to be bent before the edge of the opening die is moved downwardly into contact with the workpiece. The opening die can be separated slightly from the top surface of the workpiece and then moved to the retracted position to prevent interference with the workpiece after the workpiece has been bent. Therefore, the workpiece can be bent while protecting the top surface of the workpiece from damage.

BRIEF DESCRIPTION OF THE DRAWINGS

FIG. 11 is an enlarged front elevational view which illustrates an opening die portion of a third embodiment of the bending machine according to the present invention;

DETAILED DESCRIPTION OF THE PREFERRED EMBODIMENTS

Figure 1:
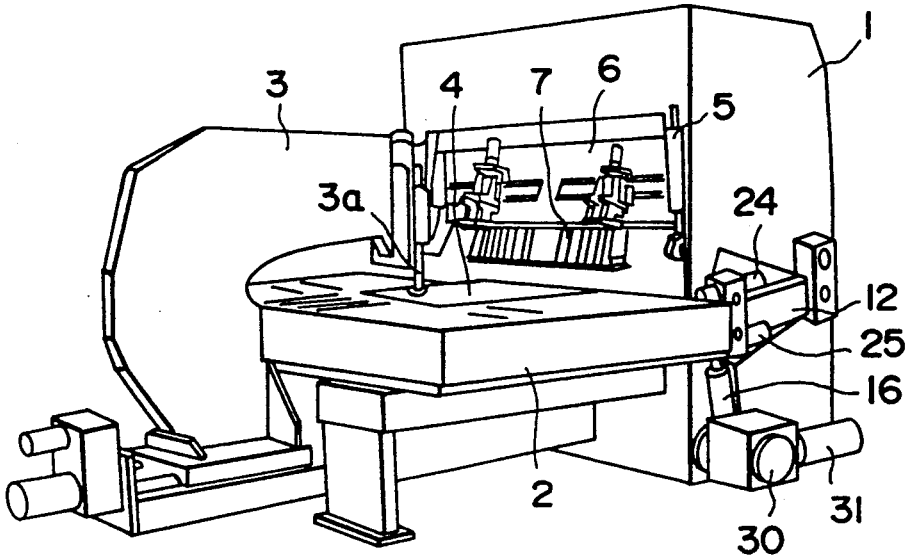
FIG. 1 is an overall perspective view which illustrates a first embodiment of a bending machine according to the present invention.

A first embodiment of the present invention will now be described with reference to FIGS. I to 8. Referring to FIG. 1, reference numeral 1 represents a body of a bending machine, 2 represents a workpiece centering device, and 3 represents a manipulator for supplying workpieces 4. The body 1 has a ram 6 in the front portion thereof, the ram 6 being vertically moved by a ram drive cylinder 5. An upper die 7 is fastened to the lower portion of the ram 6.

Figure 2:
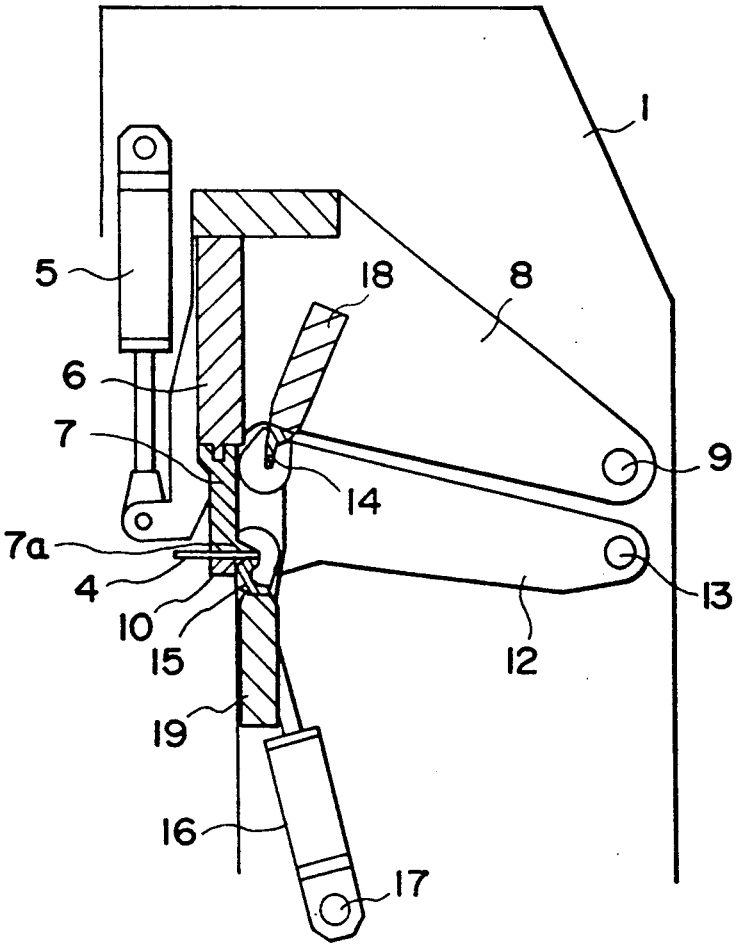
FIG. 2 is a partial vertical cross sectional view which illustrates the bending machine according to the first embodiment of the present invention.

The ram 6 has rocker arms 8 projecting rearwardly as shown in FIG. 2 in the two end portions thereof, the rocker arms 8 being rotatively hinged to the body 1 by means of pins 9 at the rear ends thereof. The upper die 7 fastened to the lower portion of the ram 6 has an edge 7*a* projecting rearwardly in the lower portion thereof so that the workpiece 4 to be bent can be held in cooperation with a stationary table 10 disposed below the upper die 7 and having a cross sectional shape which is symmetrical, with respect to the workpiece 4, to that of the adjacent portion of the upper die 7.

A bending blade selection arm 12 is disposed below each rocker arm 8. The rear end portion of each bending blade selection arm 12 is rotatively supported on the body 1 by a pin 13 positioned below the pin 9 which hinges the rear end portion of the adjacent rocker arm S. A bending blade selection cylinder 16 rotates the bending blade selection arms 12 to a first position or to a second position, to select a downward bending blade 14 in the first position or an upward bending blade 15 in the second position. The upward bending blade 15 is disposed at the lower front portion of the bending blade selection arms 12, while the downward bending blade 14 is disposed at the upper front portion of the bending blade selection arms 12. The downward bending blade 14 is fastened to the lower portion of a downward bending beam 18, while the upward bending blade 15 is fastened to the upper portion of the upward bending beam 19.

Figure 3:
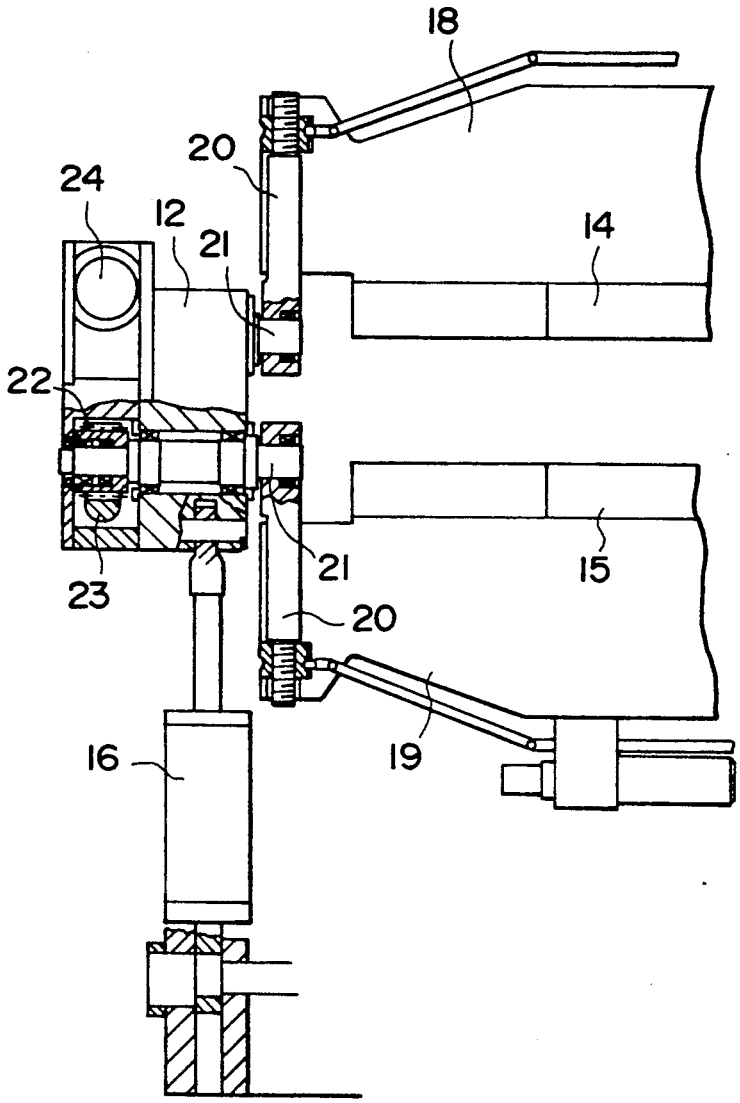
FIG. 3 is a front elevational enlarged view which illustrates a swing drive portion for swinging a downward bending beam and an upward bending beam of the bending machine according to the first embodiment of the present invention.
Figure 4:
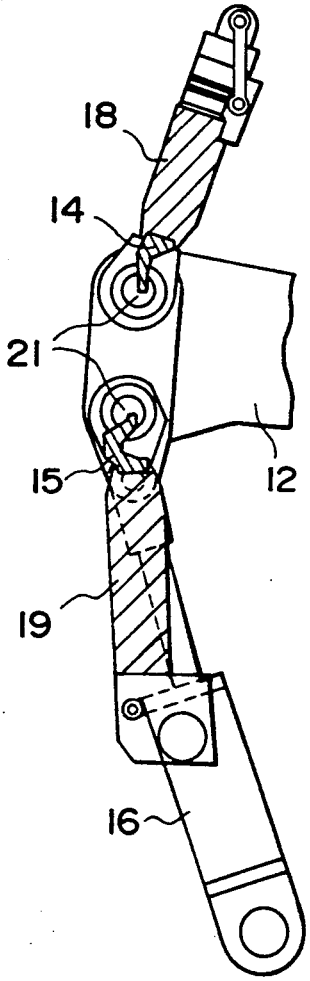
FIG. 4 is a side elevational view which illustrates the drive portion of the bending machine according to the first embodiment of the present invention.

The downward bending beam 18 and the upward bending beam 19 are disposed to move parallel to each other while being positioned vertically away from each other as shown in FIGS. 3 and 4. The downward bending blade 14 and the upward bending blade 15 are positioned so as to face each other. A pair of arm shafts 20 is disposed at the two end portions of each of the downward bending beam 18 and the upward bending beam 19. The adjacent end portions of an arm shaft 20 on one end of the downward bending beam 18 and an arm shaft 20 on the same end of the upward bending beam 15 which face each other are secured to corresponding end portions of a pair of rotational shafts 21 which are held by the respective bending blade selection arm 12 in such a manner that they are positioned away from each other in the vertical direction. The pinions 22 are respectively secured to the other end portions of the rotational shafts 21. Racks 23, slidably fastened to the bending blade selection arms 12, are engaged with the pinions 22.

Each of the racks 23 is able to move longitudinally by means of a downward bending blade swing cylinder 24 and an upward bending blade swing cylinder 25 respectively fastened to the upper and the lower portions of the bending blade selection arm 12. As a result, each of the downward bending beam 18 and the upward bending beam 19 is able to swing relative to its associated pair of rotational shafts 21.

The operation of the first embodiment will now be described. The workpiece 4 conveyed to the bending machine body 1 is located at a programmed initial position as determined by the workpiece centering device 2. Then the workpiece 4 is clamped by a clamping device 3*a* of the manipulator 3 and moved to a bending position, at which the workpiece 4 is bent. When the workpiece 4 has been located at a predetermined bending position, the ram 6 is moved downwardly by the ram drive cylinder 5 so that the workpiece 4 is held and secured by the upper die 7 and the stationary table 10, with the workpiece portion to be bent extending outwardly from the upper die 7 and stationary table 10 as a free, unsupported edge portion, as shown in dashed lines in FIG. 6.

Figure 5:
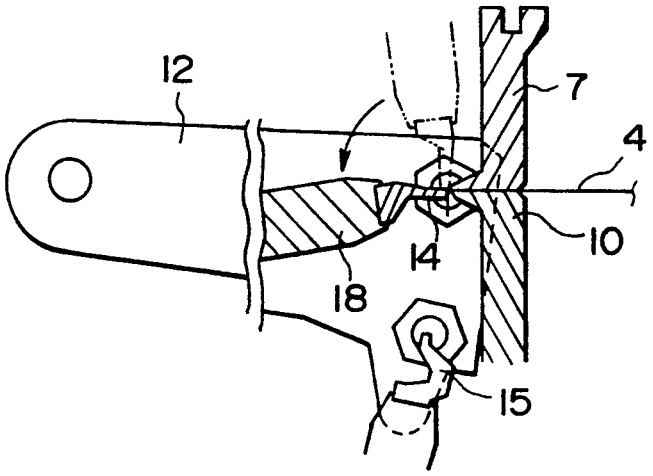
FIG. 5 is a view which illustrates the operation performed as the workpiece is bent downwardly by the bending machine according to the first embodiment of the present invention.
Figure 6:
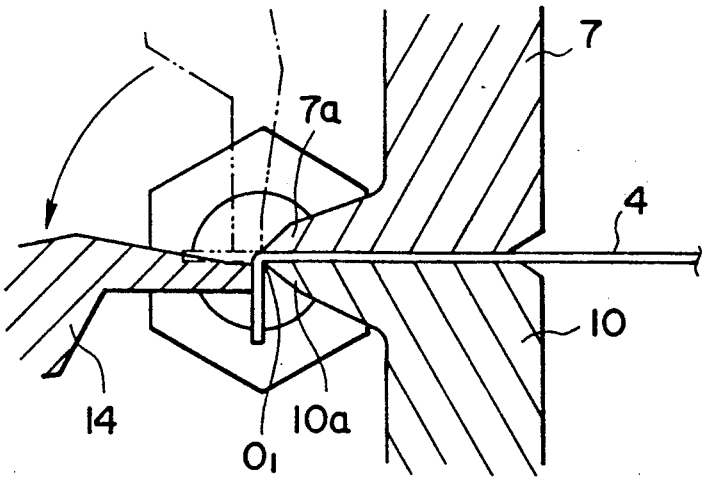
FIG. 6 is an enlarged view which illustrates a portion of the operation performed as the workpiece is bent downwardly by the bending machine according to the first embodiment of the present invention.

When the workpiece 4 is to be bent downwardly, the bending blade selection arms 12 are rotated downwardly about the pins 13 by the bending blade selection cylinders 16 so that the downward bending blade 14 is selected. When a rack 23 is slid by a downward bending blade swing cylinder 24 in this state, the pinion 22 engaged with the rack 23 is rotated, along with the associated rotational shafts 21, so that the downward bending beam 18 is swung downwardly about its associated rotational shafts 21, as shown in FIG. 5. As a result, the free edge portion of the workpiece 4 adjacent to the upper die 7 and the stationary table 10 is rotated downwardly relative to an end $0_1$ of an edge portion 10*a* of the stationary table 10, as shown in FIG. 6, and the bending operation is performed. The angle realized by this downward bending operation is determined by NC (numerical control) of the stroke of the downward bending swing cylinder 24.

After the downward bending operation of the workpiece 4 has been completed as described above, the downward bending beam 18 is restored to its initial position by the downward bending swing cylinder 24. Then, the ram 6 is moved upwardly so that the workpiece 4, an edge portion of which has been bent downwardly, is released. In this state, the manipulator 3 relocates the workpiece 4 to the next position at which the workpiece 4 is to be bent.

Figure 7:
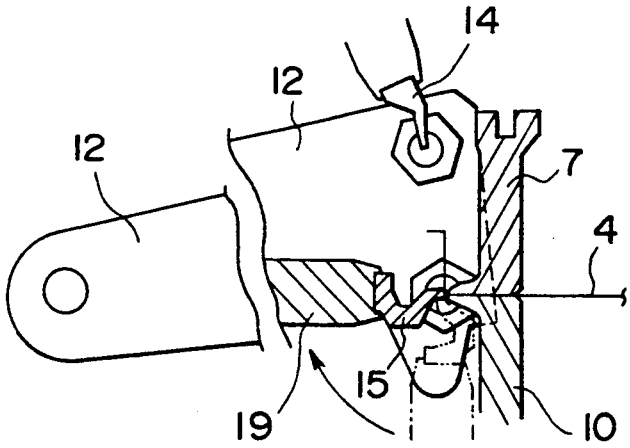
FIG. 7 is a view which illustrates the operation performed as the workpiece is bent upwardly by the bending machine according to the first embodiment of the present invention.
Figure 8:
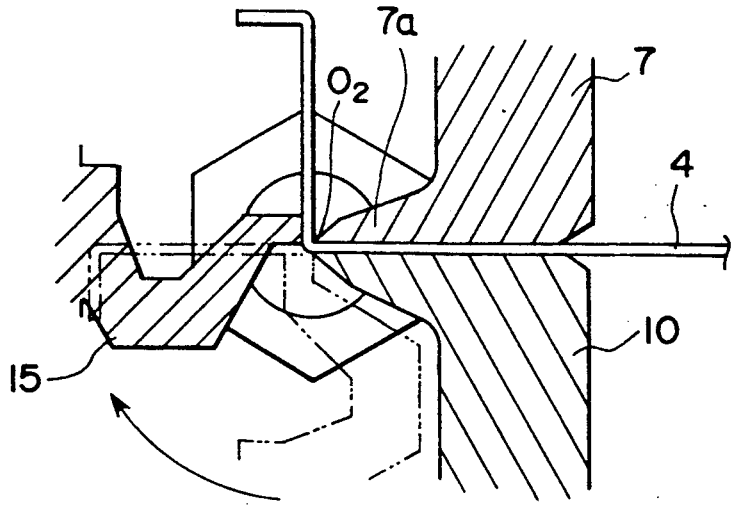
FIG. 8 is an enlarged view which illustrates a portion of the operation performed as the workpiece is bent upwardly by the bending machine according to the first embodiment of the present invention.

In the case where the workpiece 4 is to be bent upwardly, the ram 6 is moved downwardly so that the workpiece 4 is fixed between the upper die 7 and the stationary table 10, with the workpiece portion to be bent extending outwardly from the upper die 7 and stationary table 10 as a free, unsupported edge portion, as shown in dashed lines in FIG. 8. Then, the bending blade selection arms 12 are rotated upwardly about pivot pins 13 by the bending blade selection cylinders 16 so that the upward bending blade 15 is selected. In this state, the upward bending beam 19 is rotated upwardly about its associated rotational shafts 21 via the rack 23 and the pinion 22 and the upward bending blade swing cylinder 25, as shown in FIG. 7. The free edge portion of the workpiece 4 adjacent to the upper die 7 and the stationary table 10 is rotated upwardly, relative to a front end $0_2$ of the edge portion 7*a* of the upper die 7 as shown in FIG. 8, by the upward bending blade 15 fastened to the upward bending beam 19, so that the upward bending operation is performed. The angle of bending realized in this upward bending operation is determined by the NC of the stroke of the upward bending swing cylinder 25.

After the downward bending operation has been completed as described above, the upward bending beam 18 is restored to its initial position and then the ram 6 is moved upwardly. Then the workpiece 4 which has been bent is removed from the site of the bending operation. As a result, the bending operation can be accurately performed while preventing the damage of the workpiece 4.

The bending operation described above is an operation for upwardly or downwardly bending workpieces 4 having the same thickness. In a case where the thickness of the workpiece 4 is changed, the initial positions of the upward and downward bending blades 15 and 14 are corrected so that a further precise bending operation can be performed.

A second embodiment for performing the bending operation will now be described with reference to FIGS. 9 to 12. The elements which are the same as those according to the first embodiment are given the same reference numerals and their descriptions are omitted here.

Figure 9:
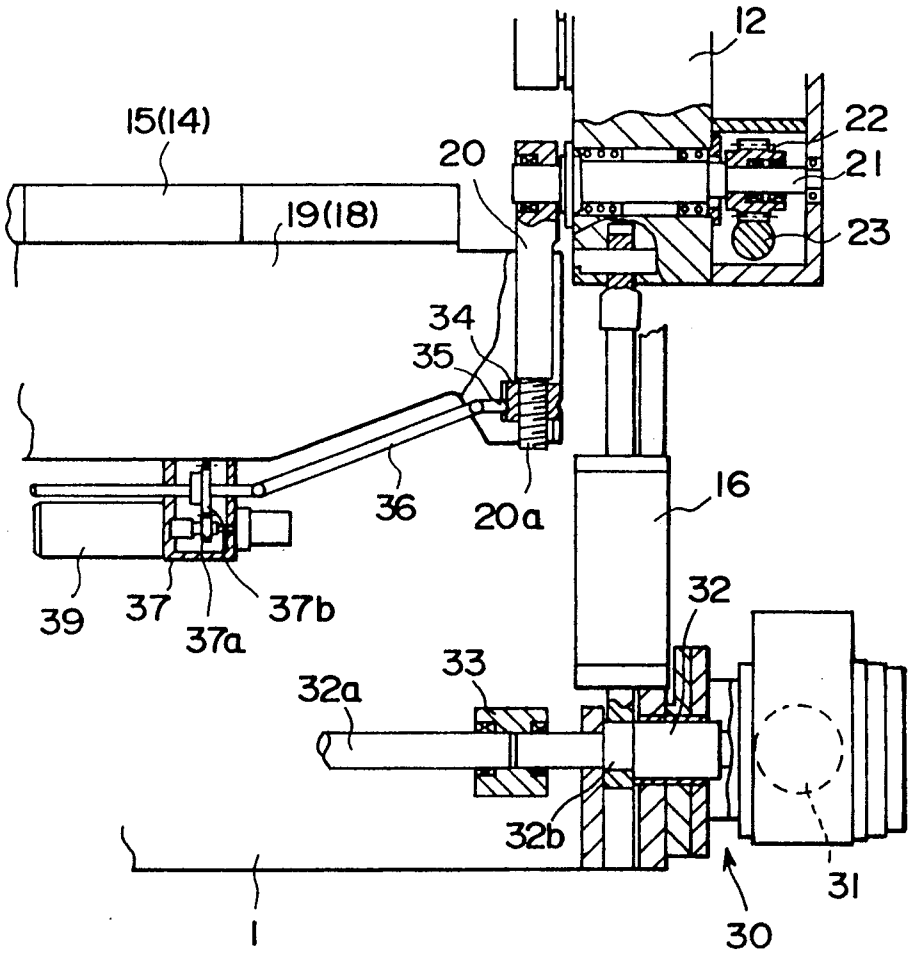
FIG. 9 is a view which illustrates a cross sectional view which illustrates a portion of a second embodiment of the bending machine according to the present invention.

Referring to FIG. 9, reference numeral 30 represents an eccentric shaft drive device having a support shaft 32 to be rotated by a servo motor 31. Right and left support shafts 32 are made to be synchronized with each other by a synchronizing shaft 32*a* via a joint 33 so as to be simultaneously rotated by the servo motor 31. The base portion of each bending blade selection cylinder 16 is held by an eccentric portion 32*b* formed on the respective support shaft 32.

Figure 10:
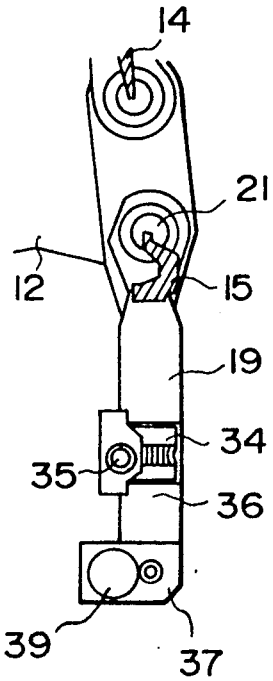
FIG. 10 is a side elevational view which illustrates the second embodiment of the bending machine according to the present invention.

A threaded portion 20*a* is formed at an end portion of each arm shaft 20 and a worm wheel 34 is engaged with the respective threaded portion 20*a*. A worm 35 is engaged with the respective worm wheel 34, as shown in FIG. 10. The worms 35 are fastened to the two end portions of propeller shafts 36 disposed along the top and bottom ends of the upward and downward bending beams 19 and 18. Servo motors 39 are connected to intermediate positions of the propeller shafts 36 via corresponding gears 37*a* and 37*b* disposed in gear boxes 37. By rotating the propeller shafts 36 by the servo motors 39, the upward bending beam 19 and the downward bending beam 18 can be moved and adjusted along the associated arm shafts 20 via the associated worms 35 and worm wheels 34.

Figure 11:
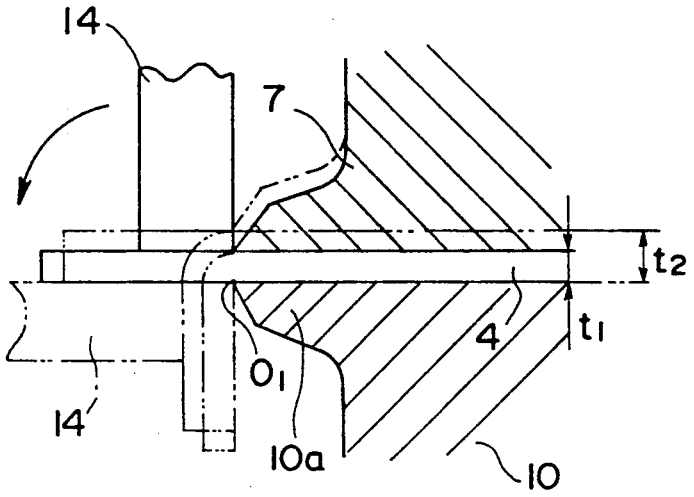
FIG. 11 is a view which illustrates the operation performed as the workpiece is bent downwardly by the bending machine according to the second embodiment of the present invention.

The operation of the second embodiment will now be described. When the workpiece 4 is to be bent downwardly, the rotation or bending center of the workpiece 4 is at the leading edge $0_1$ of the edge portion 10*a* of the stationary table 10, as shown in FIG. 11. When the free edge portion of the workpiece 4 is to be bent upwardly, the rotation center is at the leading edge $0_2$ of the edge portion 7*a* of the upper die 7, as shown in FIG. 12.

When the bending operation is performed in the case where the thickness of the workpiece 4 has been changed from t1 to t2, as shown in FIG. 11, the rotation center $0_1$ of the workpiece 4 is not changed. However, the gap between the downward bending blade 14 and the rotation center $0_1$ must be changed from t1 to t2. Therefore, the thickness t2 of the workpiece 4 is previously inputted to the NC control device so that the servo motor 39 is rotated in response to a command issued by the NC control device, causing the worm wheels 34 to be rotated via the propeller shaft 36 and the worms 35. As a result, the worm wheels 34 are driven by the action of the threads and therefore the downward bending beam 18 is moved along its arm shafts 20. Hence, the gap between the downward bending blade 14 fastened to the downward bending beam 18 and the rotation center $0_1$ is automatically adjusted to the thickness t2 of the workpiece 4 to be bent. After the adjustment has been completed as described above, the downward bending beam 18 is swung relative to its rotation shafts 21 so that the workpiece 4 is bent downwardly.

Figure 12:
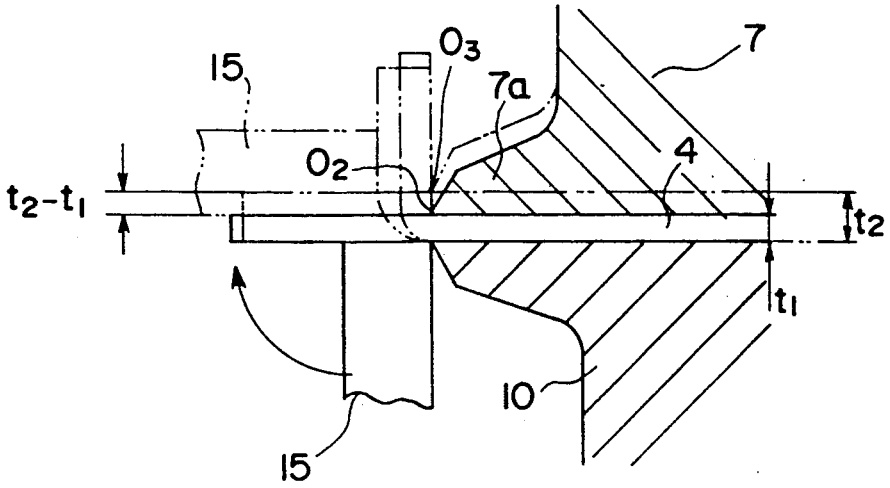
FIG. 12 is a view which illustrates the operation performed as the workpiece is bent upwardly by the bending machine according to the second embodiment of the present invention.

When the workpiece 4 is to be bent upwardly in the case where the thickness of the workpiece 4 has been changed from t1 to t2, the rotation center of the workpiece 4 must be changed from $0_2$ to $0_3$ and the gap between the upward bending blade 15 and the rotation center must be changed from t1 to t2, as shown in FIG. 12. Therefore, the thickness t2 of the workpiece 4 is previously inputted to the NC control device so that the upward bending beam 19 is moved along its arm shafts 20 similarly to the case where the workpiece 4 is to be bent downwardly. As a result, the gap between the upward bending blade 15 fastened to the upward bending beam 19 and its rotation center $0_3$ is automatically adjusted from t1 to t2.

On the other hand, the base portion of each bending blade selection cylinders 16 for vertically swinging the respective bending blade selection arm 12 is held by an eccentric portion **32*b* formed on the support shaft 32 of the eccentric shaft drive device 30. As a result, the change of the position of the upward bending blade 15 required due to the change of the thickness of the workpiece 4 can be automatically performed by the NC control by rotating the support shafts 32 by the servo motor 31. That is, in the case where the thickness of the workpiece 4 has been changed from t1 to t2, the support shafts 32 can be rotated by the servo motor 31 in such a manner that the top position of the bending blade selection cylinder 16 is translated by the amount represented by (t2 - t1). Hence, the rotation center of the upward bending blade 15 is automatically adjusted from $0_2$ to $0_3$. If the thickness of the workpiece 4** has been changed as described above, the bending machine according to the present invention can be adapted to a bending operation system line which can be automatically operated.

A third embodiment of the present invention will now be described with reference to FIGS. 13 to 18. The elements which are the same as in the first embodiment are given the same reference numerals and their descriptions are omitted here.

Figure 13:
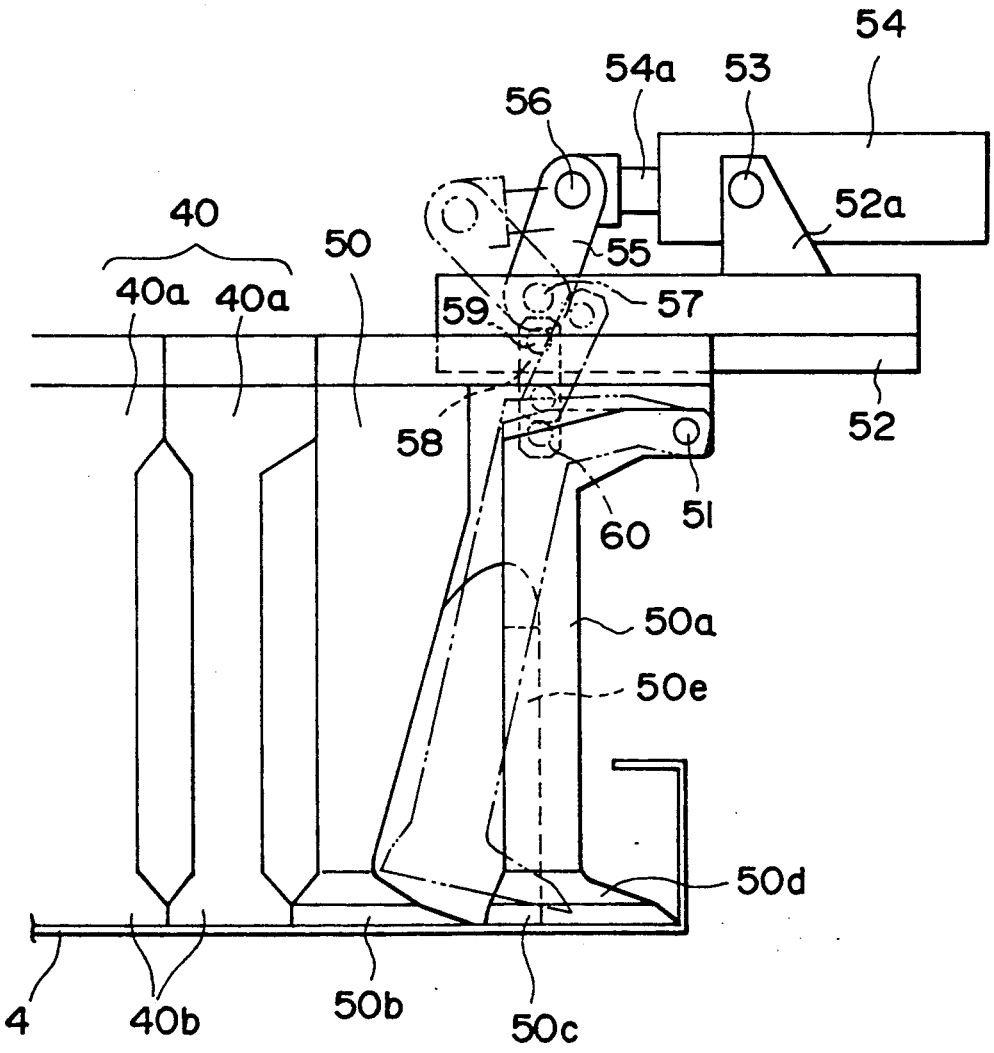

An upper die group 40 shown in FIG. 13 is composed of a multiplicity of separated upper dies **40*a*. An opening die body 50 is disposed adjacent to the two end portions of the upper die 40*a***.

An opening die **50*a* is rotatively hinged to the upper edge of the opening die body 50 by a pin 51. Edges 50*b* and 50*c* of the opening die body 50 and the opening die 50*a* are formed to be linearly continued from the edge 40*b* of the upper die group 40. A projection portion 50*d* projecting outwardly is formed in the lower portion of the opening die 50*a*. The opening die body 50 has an elongated reinforcement member 50*e* disposed vertically so as to be integrated with the opening die 50*a* to reinforce it when the opening die 50*a* has been brought to the position at which the workpiece 4** is to be bent. Hence the bending accuracy can be improved.

On the other hand, a fastening base plate 52 is horizontally secured to the upper portion of the opening die body 50, the fastening base plate 52 having, on the top surface thereof, a projecting bracket **52*a* to which an actuator 54 is hinged by a pin 53. The top surface of a link 55 is hinged by a pin 56 to the leading portion of a piston rod 54*a* projecting from the actuator 54 toward the upper die group 40**.

The lower end of the link 55 is rotatably received on a support shaft 57 on the fastening base plate 52. The lower end of the link 55 is also hinged to the top end of the link 58 by a pin 59. The lower end of the link 58 is hinged by a pin 60 to the upper portion of the opening die **50*a*. By elongating and contracting the actuator 54, the opening die 50*a* can be rotated relative about the pin 51 from a first position which is designated by a solid line and at which the workpiece 4 is bent, to a second position which is designated by a phantom line and to which the opening die 50*a* is retracted to prevent the interference. Element 61 is an upper clamp for fastening the upper die group 40 and the opening die body 50**.

The operation of the third embodiment will now be described with reference to FIGS. 15 to 18.

Figure 17:
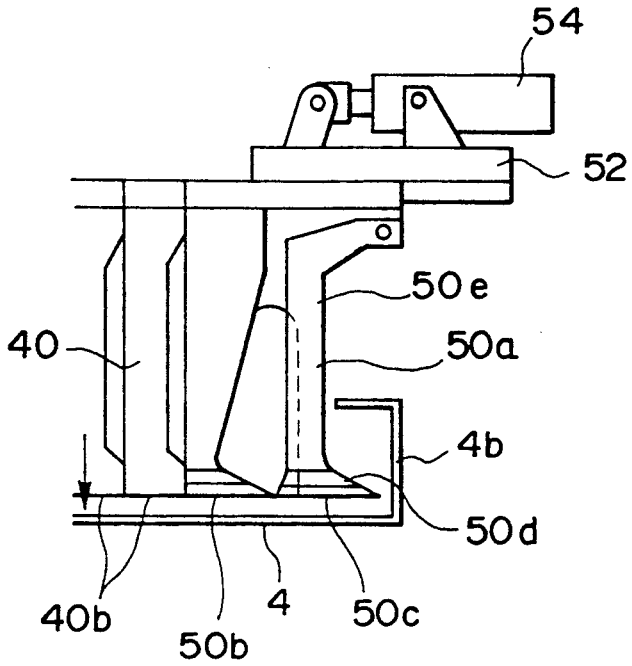

First, the workpiece 4, the shorter side edge **4*b* of which has been bent into a U-shape facing side, is positioned and secured. The opening die 50*a* is retracted by the actuator 54 to prevent the interference. Then, the ram 6 is moved downwardly so that the edge 40*b* of the upper die group 40 is lowered to a position of several millimeters above the top surface of the workpiece 4. At this time, the ram 6 is temporarily stopped, and the opening die 50*a* is rotated by the actuator 54 about the pin 51 to a position at which the workpiece 4 is bent, as shown in FIG. 17**.

Figure 18:
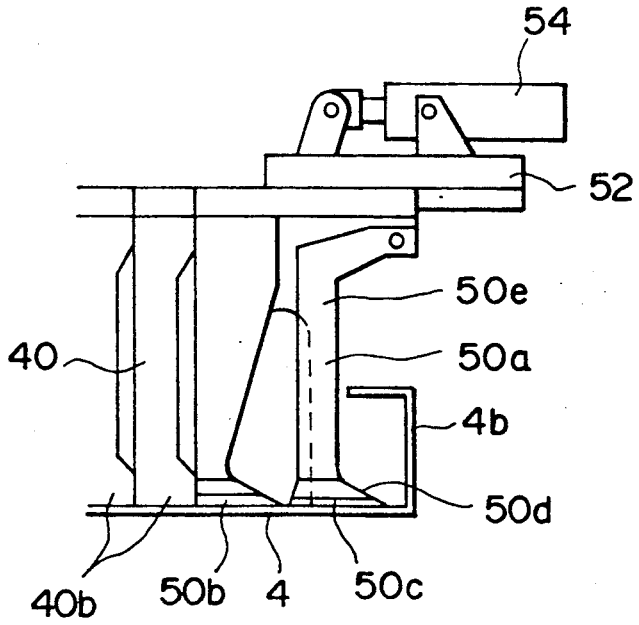
Figure 19:
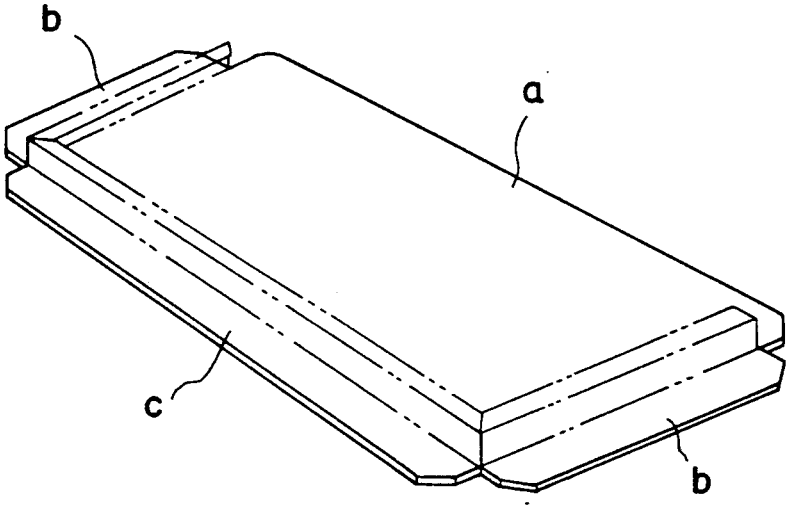
FIG. 19 (PRIOR ART)
FIG. 19 is a view which illustrates a conventional bending operation.

Then, the ram 6 is again moved downwardly, as shown in FIG. 18, until the edge **40*b* of the upper die group 40 and the edge 50*b* of the opening die body 50 and the edge 50*c* of the opening die 50*a* are brought into contact with the top surface of the workpiece 4**.

Figure 14:
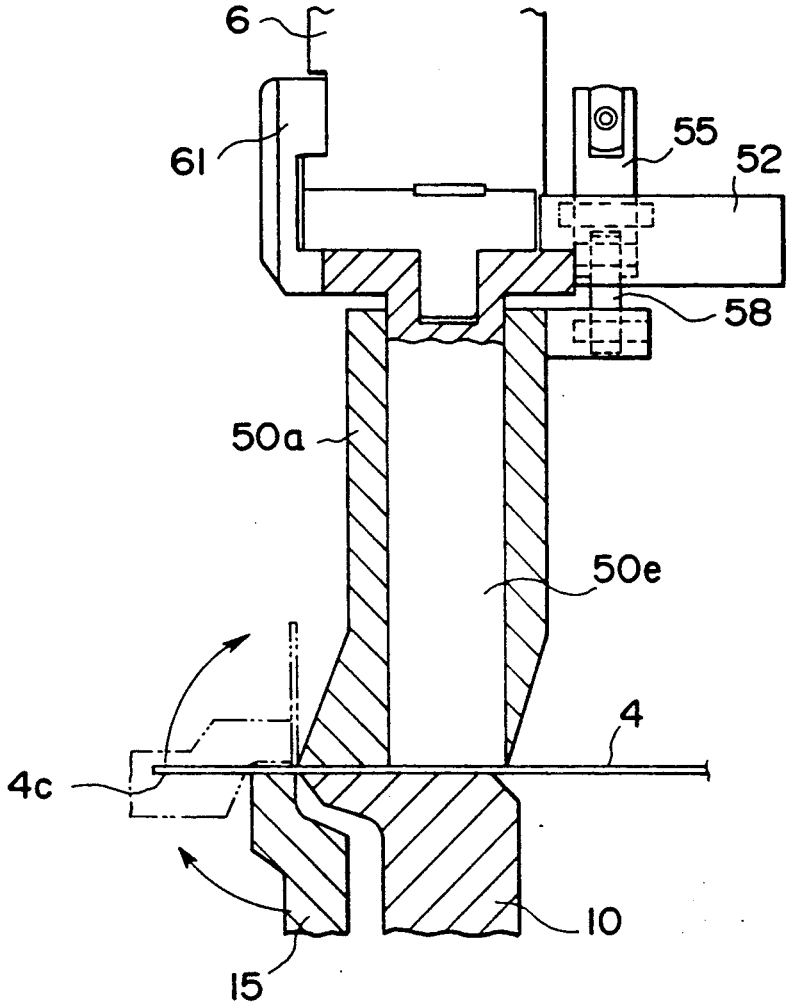
FIG. 14 is an enlarged side elevational view which illustrates the opening die portion of the third embodiment of the bending machine according to the present invention.
Figure 15:
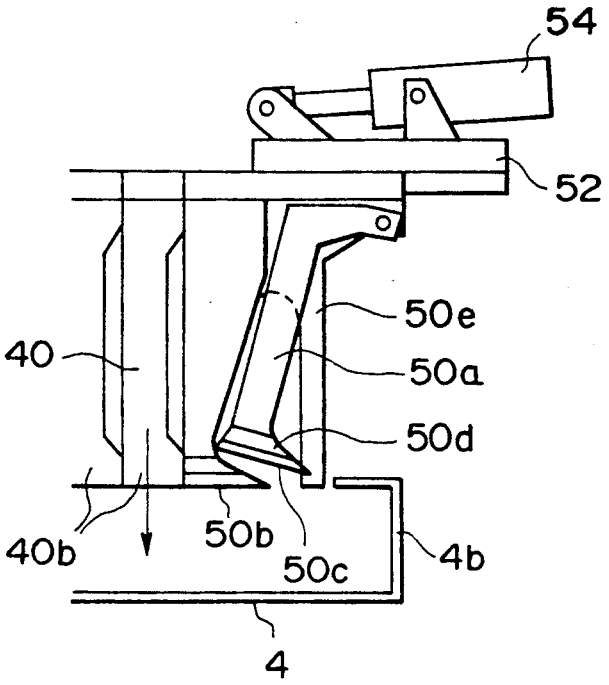
FIGS. 15 to 18 are views which illustrate the operation performed as the workpiece is bent by the bending machine according to the third embodiment of the present invention.
Figure 16:
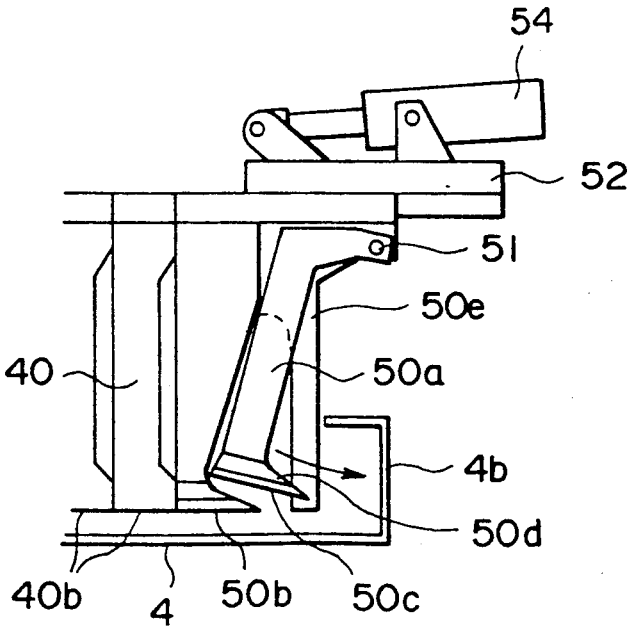

In this state, the upward bending blade 15 is swung upwardly as shown in FIG. 14 so that the longer side edge **4*c* of the workpiece 4 is bent upwardly. After the upward bending operation has been completed, the ram 6 is moved upwardly slightly, and then the opening die 50*a* is again retracted by the actuator 52 to the position to prevent the interference. Then the ram 6** is moved upwardly to the top dead center.

Therefore, the die separation can be performed while preventing the problem of the projection portion **50*d* of the opening die 50*a* being caught by the shorter side edge 4*b*. Although the third embodiment is arranged to bend the workpiece 4** by using a panel former, the present invention may, of course, be adapted to a panel bender or a press brake.

According to the present invention, the bending operation can be performed while protecting the surface of a workpiece from damage even if the workpiece has a surface treatment, because the upward bending blade and the downward bending blade do not rub the workpiece during the bending operation. Even if a variety of workpieces having different thickness are to be bent, an automatic operation can be performed in accordance with a schedule by previously inputting the various thicknesses.

Furthermore, even if a workpiece has been partially bent, it can be assuredly further bent in an additional bending operation wherein the die can be also removed while protecting the surface of the workpiece from damage.

Although the invention has been described in its preferred form with a certain degree of particularly, it is understood that the present disclosure of the preferred form can be changed in the details of construction and in the combination and arrangement of parts without departing from the spirit and the scope of the invention as hereinafter claimed. For example, while several actuators have been described as cylinders, other suitable actuators can be employed. Terms such as "upward" and "downward" are utilized herein to designate the orientation of the bending operations in at least generally opposite directions without necessarily referring to a gravitational vertical.

What is claimed is:

1. A bending machine comprising:

a frame;

a stationary table supported on said frame;

a ram movably mounted on said frame;

an upper die fastened to said ram, said ram and said upper die being movable and acting in cooperation with said stationary table to secure between said stationary table and said upper die a workpiece which is to be bent about a bending line;

a bending blade selection arm movably mounted on said frame;

a downward bending beam rotatably mounted to said bending blade selection arm at a first location thereon for rotation with respect to said bending blade selection arm;

a downward bending blade mounted on said downward bending beam;

an upward bending beam rotatably mounted to said bending blade selection arm at a second location thereon for rotation with respect to said bending blade selection arm, an upward bending blade mounted on said upward bending beam;

said first and second locations being spaced apart from each other so that each of said downward bending blade and said upward bending blade can be rotated with respect to said bending blade selection arm while said downward bending blade and said upward bending blade are maintained separate from each other;

a bending blade selection actuator for moving said bending blade selection arm between a first position and a second position, whereby said downward bending blade contacts a workpiece along a surface of the workpiece opposite said bending line when said bending blade selection arm is in said first position and said upward bending blade contacts a workpiece along a surface of the workpiece opposite said bending line when said bending blade selection arm is in said second position;

a downward bending blade actuator for rotating said downward bending beam and said downward bending blade, with respect to said bending blade selection arm, about said bending line when said bending blade selection arm is in said first position, said workpiece is fixed between said upper die and said stationary table, and said downward bending blade is in contact with said workpiece, to thereby downwardly bend a portion of said workpiece about said bending line; and an upward bending blade actuator for rotating said upward bending beam and said upward bending blade, with respect to said bending blade selection arm, about said bending line when said bending blade selection arm is in said second position, said workpiece is fixed between said upper die and said stationary table, and said upward bending blade is in contact with said workpiece, to thereby upwardly bend a portion of said workpiece about said bending line.

2. A bending machine in accordance with claim 1, wherein said bending blade selection arm is rotatably mounted on said frame, and wherein said bending blade selection arm can be rotated by said bending blade selection actuator to said first position and to said second position.

3. A bending machine in accordance with claim 2, further comprising means for varying the center of rotation of said upward bending beam in accordance with the thickness of the portion of the workpiece to be bent.

4. A bending machine in accordance with claim 2, wherein said bending line is a line of contact between the workpiece and an edge of said stationary table when said bending blade selection arm is in said first position, and wherein said bending line is a line of contact between the workpiece and an edge of said upper die when said bending blade selection arm is in said second position.

5. A bending machine in accordance with claim 4, wherein said bending blade selection actuator comprises a bending blade selection cylinder, wherein said downward bending blade actuator comprises a downward bending blade swing cylinder, and wherein said upward bending blade actuator comprises an upward bending blade swing cylinder.

6. A bending machine in accordance with claim 5, further comprising means for varying the center of rotation of said upward bending beam in accordance with the thickness of the portion of the workpiece to be bent.

7. A bending machine in accordance with claim 2, wherein there are two bending blade selection arms located at opposite ends of said downward bending beam and said upwardly bending beam; and further comprising:

a first pair of coaxial rotational shafts having a common longitudinal axis and mounted for rotation about their common longitudinal axis, each of said first pair of coaxial rotational shafts being mounted in a respective one of said bending blade selection arms;

a first pair of arm shafts, said downward bending beam being mounted on said first pair of arm shafts, one end of each of said first pair of arm shafts being mounted on a respective one of said first pair of coaxial rotational shafts for rotation with respect thereto;

a second pair of coaxial rotational shafts having a common longitudinal axis and mounted for rotation about their common longitudinal axis, each of said second pair of coaxial rotational shafts being mounted in a respective one of said bending blade selection arms;

a second pair of arm shafts, said upward bending beam being movably mounted on said second pair of arm shafts, one end of each of said second pair of arm shafts being mounted on a respective one of said second pair of coaxial rotational shafts for rotation with respect thereto;

whereby each of said downward bending beam and said upward bending beam can be rotated about the longitudinal axis of its associated pair of coaxial rotational shafts, and wherein the longitudinal axis of said first pair of coaxial rotational shafts coincides with said bending line when said bending blade selection arm is in its first position and the longitudinal axis of said second pair of coaxial rotational shafts coincides with said bending line when said bending blade selection arm is in its second position.

8. A bending machine in accordance with claim 7, wherein said bending blade selection actuator comprises a bending blade selection cylinder having a base; said machine further comprising an eccentric shaft drive device for adjusting the position of the base of the bending blade selection cylinder to adjust a rotation center of the upward bending blade in accordance with a thickness of the workpiece.

9. A bending machine in accordance with claim 7, wherein at least one of said downward bending beam and said upward bending beam is movably mounted on its associated pair of arm shafts, and further comprising means for varying the position of at least one of said downward bending beam and said upward bending beam on its associated pair of arm shafts.

10. A bending machine in accordance with claim 9, wherein said means for varying comprising a threaded portion on each arm shaft of the pair of arm shafts associated with a respective bending beam, a gear on each arm shaft in the pair of arm shafts associated with the respective bending beam, each gear being in engagement with the respective threaded portion and the respective bending beam so that the position of the gears on the threaded portions determines the position of the respective bending beam on its pair of arm shafts, and means for rotating said gears to thereby adjust the position of the respective bending beam on its pair of arm shafts.

11. A bending machine in accordance with claim 10, wherein said bending blade selection actuator comprises a bending blade selection cylinder having a base; said machine further comprising an eccentric shaft drive device for adjusting the position of the base of the bending blade selection cylinder to adjust a rotation center of the upward bending blade in accordance with a thickness of the workpiece.

12. A bending machine in accordance with claim 2, wherein said ram is movable vertically, and wherein said bending blade selection arm can be swung vertically by said bending blade selection actuator between said first position and said second position in such a manner that said downward bending beam and said upward bending beam are able to swing vertically while being maintained vertically separated from each other.

13. A bending machine in accordance with claim 12, further comprising means for varying the center of swinging of said upward bending beam in accordance with the thickness of the portion of the workpiece to be bent.

14. A bending machine in accordance with claim 12, wherein the height at which said bending blade selection arm is swung can be adjusted in accordance with the thickness of the workpiece.

15. A bending machine in accordance with claim 1, further comprising means for varying the center of rotation of said upward bending beam in accordance with the thickness of the portion of the workpiece to be bent.

16. A bending machine in accordance with claim 1, wherein said upper die comprises an upper die group fastened to said ram and having two end portions, at least one of the two end portions of said upper die group having an opening die body disposed thereat, and at least one opening die, the upper portion of each said opening die being rotatively fastened to a respective opening die body; and further comprising at least one opening die actuator so that each said opening die can be rotated by a respective one of said at least one opening die actuator to a first opening die position prior to the respective opening die contacting the workpiece to be bent, each opening die being maintained at its said first opening die position by the respective opening die actuator while the workpiece is being bent, and so that each said opening die can be slightly separated from the workpiece by the respective opening die actuator after the workpiece has been bent and then rotated by the respective opening die actuator to a second opening die position so that each opening die can be further separated from the workpiece without interference with the workpiece.

17. A bending machine for bending a workpiece, said machine comprising:

a frame;

a table;

a ram movably mounted on said frame;

an upper die group fastened to said ram and acting in cooperation with said table to secure therebetween a workpiece to be bent, said upper die group having two end portions;

a bending blade movably mounted on said frame for bending said workpiece secured between said upper die group and said table;

at least one of the two end portions of said upper die group having an opening die body disposed thereat;

at least one opening die actuator;

at least one opening die, the upper portion of said at least one opening die being rotatively fastened to a respective opening die body, wherein each said opening die can be rotated by a respective one of said at least one opening die actuator to a first position prior to the respective opening die contacting the workpiece to be bent, each opening die being maintained at its said first position by the respective opening die actuator while the workpiece is being bent, and so that each said opening die can be slightly separated from the workpiece by the respective opening die actuator after the workpiece has been bent and then rotated by the respective opening die actuator from said first position to a second position so that each opening die can thereafter be further separated from the workpiece without interference with the workpiece.

18. A bending machine in accordance with claim 17, wherein said at lest one opening die is rotated to said first position before the upper die group is brought into contact with the top surface of the workpiece to be bent.

19. A bending machine in accordance with claim 18, wherein said at least one opening die is rotated to said second position after the upper die group, the at least one opening die body and the at least one opening die have been brought into contact with and then separated from the top surface of the workpiece.

20. A bending machine in accordance with claim 17, wherein each said opening die actuator has a piston rod, and wherein each said piston rod is connected by a linkage to the associated opening die.

* * * * *